US008651128B2

(12) United States Patent
Boyer et al.

(10) Patent No.: US 8,651,128 B2
(45) Date of Patent: Feb. 18, 2014

(54) METHODS AND APPARATUS FOR ISOLATING A SECTION OF FLUID LINE

(75) Inventors: Mark L. Boyer, Houston, TX (US); Billy D. Kelley, Houston, TX (US); William D. O'Fiel, Houston, TX (US); Michael E. Parsons, Cypress, TX (US)

(73) Assignee: Boyer Inc., Houston, TX (US)

( * ) Notice: Subject to any disclaimer, the term of this patent is extended or adjusted under 35 U.S.C. 154(b) by 587 days.

(21) Appl. No.: 12/908,950

(22) Filed: Oct. 21, 2010

(65) Prior Publication Data

US 2012/0097263 A1 Apr. 26, 2012

(51) Int. Cl.

| | |
|---|---|
| ***E03B 5/00*** | (2006.01) |
| ***F04B 23/00*** | (2006.01) |
| ***F04F 1/00*** | (2006.01) |
| ***F16L 55/10*** | (2006.01) |
| ***F17D 5/02*** | (2006.01) |
| ***F16L 55/18*** | (2006.01) |

(52) U.S. Cl.
USPC ..... 137/15.11; 137/15.16; 138/93; 138/94.3; 405/184.1

(58) Field of Classification Search
USPC ..... 137/15.08, 15.09, 15.11, 15.16, 15.17; 138/89, 93, 94.3, 109, 178; 405/107, 405/108, 116, 118, 119, 129.6, 154.1, 156, 405/184.1, 184.3
See application file for complete search history.

(56) References Cited

U.S. PATENT DOCUMENTS

| | | | | |
|---|---|---|---|---|
| 3,333,814 | A * | 8/1967 | Sargent | 251/203 |
| 4,529,359 | A * | 7/1985 | Sloan | 417/34 |
| 5,076,095 | A * | 12/1991 | Erhardt | 73/49.8 |
| 5,161,911 | A * | 11/1992 | Regan | 405/37 |
| 5,524,663 | A * | 6/1996 | Walsh et al. | 137/15.23 |
| 6,655,413 | B2 * | 12/2003 | Condon et al. | 138/94.3 |
| 6,997,041 | B1 * | 2/2006 | Metzger et al. | 73/37 |

OTHER PUBLICATIONS

NPL Dam Basics, www.pbs.org/wgbh/buildingbig/dam/basics.html, dated 2001.*
NPL Bypass 101, www.wwdmag.com/sites/default/files/bypass101.pdf, dated Jul. 2009.*
NPL New England, www.neiwpcc.org/neiwpcc_docs/webom&r.appendixc.pdf, dated Dec. 3, 2003.*
NPL International, www.nassco.org/publications/specs/spec_guidelines/ pipebursting-ipba.pdf, dated Jul. 9, 2009.*
NPL Pierce County, www.co.pierce.wa.us/documentcenter/view/859, dated Jan. 1, 2002.*

* cited by examiner

*Primary Examiner* — Stephen M Hepperle
*Assistant Examiner* — Frederick D Soski
(74) *Attorney, Agent, or Firm* — Patterson & Sheridan, LLP

(57) ABSTRACT

A method and apparatus for isolating a section of sewer line. In one embodiment, a chamber is provided that extends into the ground and intersects a sewer pipe. Thereafter, the fluid in the sewer pipe is exposed to an interior of the chamber and a dam is placed in the chamber to isolate an upstream portion of the chamber from a downstream portion. As fluid collects in the upstream side of the chamber, at least one pump is used to control the fluid level in the upstream portion by transferring the fluid from the chamber to a predetermined, remote location.

13 Claims, 3 Drawing Sheets

METHODS AND APPARATUS FOR ISOLATING A SECTION OF FLUID LINE

BACKGROUND OF THE INVENTION

1. Field of the Invention

The present invention relates to subterranean fluid lines. More specifically, the invention relates sewage systems. More particularly still, the invention relates to improved methods and apparatus for isolating a section of a fluid line.

2. Description of the Related Art

Pumping stations in sewage collection systems, also called lift stations, are normally designed to handle raw sewage that is fed from underground gravity pipelines (pipes that are laid at an angle so that a liquid can flow in one direction under gravity). Sewage is fed into and stored in an underground pit, commonly known as a wet well. The well is equipped with electrical instrumentation to detect the level of sewage present. When the sewage level rises to a predetermined point, a pump or pumps will be started to lift the sewage upward through a pressurized pipe system from where the sewage is discharged into a gravity manhole. From there, the cycle starts all over again until the sewage reaches its point of destination—usually a treatment plant. By this method, pumping stations are used to move waste to higher elevations.

Sewage pumping stations are typically designed so that one pump or one set of pumps will handle normal peak flow conditions. Redundancy is built into the system so that in the event any one pump is out of service, the remaining pump or pumps will handle the designed flow. There are a lot of electronic controllers designed specially for this application. The storage volume of the wet well between the 'pump on' and 'pump off' settings is designed to minimize pump starts and stops, but is not so long a retention time as to allow the sewage in the wet well to overflow. In the case of high sewage flows into the well (for example during peak flow periods and in system also handling rain water), additional pumps will be used. If this is insufficient, or in the case of failure of the pumping station, a backup in the sewer system can occur leading to a sanitary sewer overflow—the discharge of raw sewage into the environment.

Pump stations and/or sections of sewer lines are taken off-line for a variety of reasons including equipment failure and/or maintenance. Breakdown due to corrosion is typical. Sewage infrastructure corrosion occurs when sewage gas ($H_2S$) is converted to sulfuric acid ($H_2SO_4$) by the action of bacteria. Currently, the stations are taken off-line using methods that are time-consuming, difficult and dangerous. For example, in one method an inflatable pig-like device is inserted in the sewer via a manhole at some location upstream of the trouble zone. Thereafter, the pig is inflated in order to expand and block the flow of fluid. At the same time, the fluid is re-routed at a location downstream of the pig. Isolating a section of sewer in this manner is effective, but working downstream of an inflated pig is inherently dangerous in the event of deflation or rupture of the pig, which can result in a renewed flow of fluid in the direction of workers in the sewer who may not have an avenue for safe exit. In other instances, lift stations at water treatment facilitates fail and the resulting repairs on pumps is inefficient due to the presence of temporary pumps and flow lines in and around the facility.

What is needed is an efficient and safe way to isolate one section of a sewer from another section or from a lift or treatment facility.

SUMMARY OF THE INVENTION

The invention includes methods and apparatus for isolating a section of fluid line. In one embodiment, a chamber is provided that extends into the ground and intersects a sewer pipe. Thereafter, the fluid in the sewer pipe is exposed to an interior of the chamber and a dam is placed in the chamber to isolate an upstream portion of the chamber from a downstream portion. As fluid collects in the upstream side of the chamber, at least one pump is used to control the fluid level in the upstream portion by transferring the fluid from the chamber to a predetermined, remote location.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

In this specification, the term "sewage" or "sewer line" refers to any subterranean fluid path in a conductor regardless of the type of fluid. For instance, the principles of the invention are equally usable with waste sewage or storm sewage or both.

Figure 1:
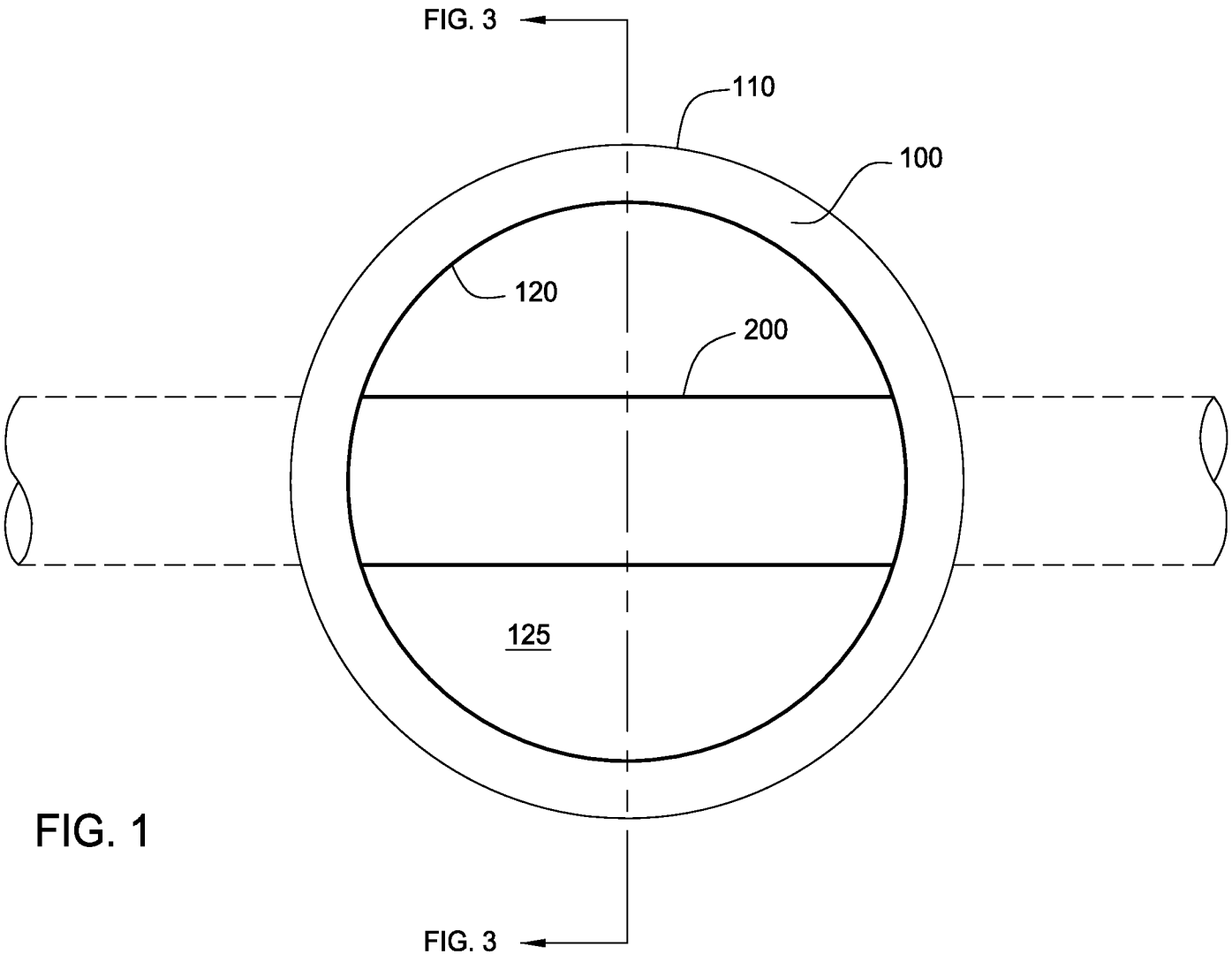
FIG. 1 is top view of a diversion chamber installed in the ground and intersecting a sewer pipe.

FIG. 1 is a top view of a diversion chamber 100 formed in the ground to access a sewer line 200, which in the case of FIG. 1 is a tubular member. The chamber is a relatively large diameter (typically 20 feet) and is either constructed over an existing, large diameter sewer pipe (48 inches in diameter for example) or constructed at the time the sewer is originally installed. The chamber 100 is made of reinforced structural concrete usually by driving piles in the ground and then using the inwardly facing surface of each pile to form the wall 110 of the chamber. The interior walls are lined with a non-corrosive material 120, like PVC, to prevent corrosion. The location of the chamber is typically adjacent to and just upstream of a pump station wet well or influent junction box that might need to be taken off-line at any time. The most likely candidate for a diversion chamber is a lift station at a sewage treatment facility where current methods of diversion cause the most disruption. In another instance, a chamber might be built upstream of a problem area of sewer pipe (due to breakage or collapse) or even to bypass a section of sewer while unrelated road or other infrastructure work takes place.

Sewer lines can be anywhere from 20 to 100 feet or more underground, and the chamber is designed and built whereby the floor 125 of the chamber is at a depth of the centerline of the sewer pipe 200. In this manner, the top half of the sewer pipe can be removed and the bottom half left in place to operate as a trough for fluid. For example, if the chamber is retrofit to an existing sewer line, the depth of the line is determined and the chamber is excavated to a depth equal to the centerline of the sewer pipe. If the chamber is built at the time the sewer pipe is laid, its floor is similarly positioned relative to the pipe. The chamber is typically round and includes a precast, removable top slab (not shown) that can be covered with any material including pavement to conceal the existence of the chamber. Under normal conditions, the chamber is a static access point to the sewer and includes no permanent equipment like valves, gates or pumps. The purpose of the chamber 100 is to remain protected from long-term deterioration but be functional when needed.

Figure 2:
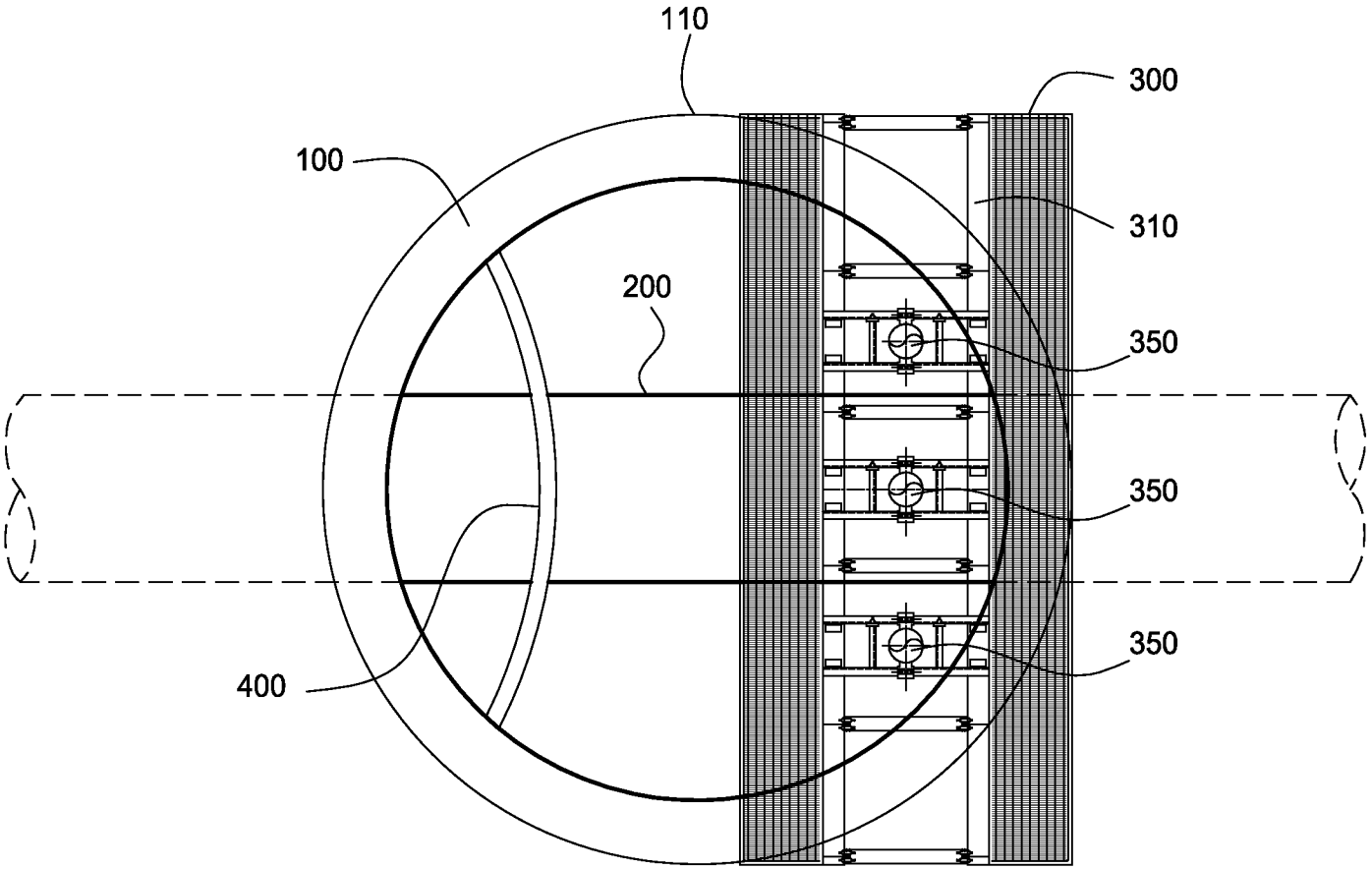
FIG. 2 is another top view of the diversion chamber showing a pump assembly at an upper edge of the chamber and a dam installed in the chamber.

FIG. 2 is another top view of the diversion chamber 100 showing a pump assembly 300 at an upper end of the chamber and a dam 400 installed in the chamber. In FIG. 2, the chamber appears as it would just prior to a diversion operation. The pump assembly 300 includes a frame 310 designed to be a temporary and simple means of providing pumps 350 at the location of the chamber in the event a diversion is necessary. The frame 310 is supported by the walls 110 of the chamber and in turn supports the weight of the pumps 350 that are used to divert fluid from the chamber 100 to a remote location. In FIG. 2, three pumps 350 are shown but any number can be used depending on requirements of a particular diversion job. The pumps 350 are lowered into the chamber 100 with a crane (not shown). Thereafter, they are suspended from the frame 310 by steel pipes (not shown) which provide a conduit for the fluid between the pump output and the top of the chamber. High-density PVC pipe (not shown) carries the diverted fluid to another location where it is re-introduced into the permanent sewer line, or in some cases, directly into a treatment plant. Pipe used to carry diverted fluid can be of most any construction and type so long as it is sized to handle the given volume of fluid. The pumps 350 are typically submersible pumps that are powered either by a generator or a nearby power source, and temporary controls, including fluid level sensors, are installed with the assembly 300.

Also visible in FIG. 2 is dam 400, like a coffer dam that serves as an enclosure within a water environment to allow water to be pumped out and replaced by air for the purpose of creating a dry environment. The dam is shown in other detail in FIG. 3. The dam 400 includes vertical sections 401, 402 that can be stacked to increase the overall height of the dam depending upon the level of fluid in the chamber 100 during a diversion. For example, if fluid is expected to rise to a level of 50 feet, five 10-foot sections 401-405 can be assembled and installed in the chamber to provide the adequate height. A tongue portion 425 formed at a lower end of the lowermost section 401 of the dam 400 is constructed and arranged to extend into and seal against a half-circle shape 205 of the sewer pipe 200 that remains after the top portion of the pipe is removed. The dam 400 is also designed to seal against the chamber wall 110 due to hydraulic pressure of fluid acting upon a convex side 430 of the dam. Corrosive resistant rubber seals (not shown) between the edges of the dam and the chamber wall ensure a watertight seal. Both the dam 400 with its multiple sections 401, 402 and the pump assembly 300 are intended to be easily installed in the chamber 100 when they are needed and easily removed after a diversion job is complete. Typically, each will be stored in a location where they are rapidly deployable.

Figure 3:
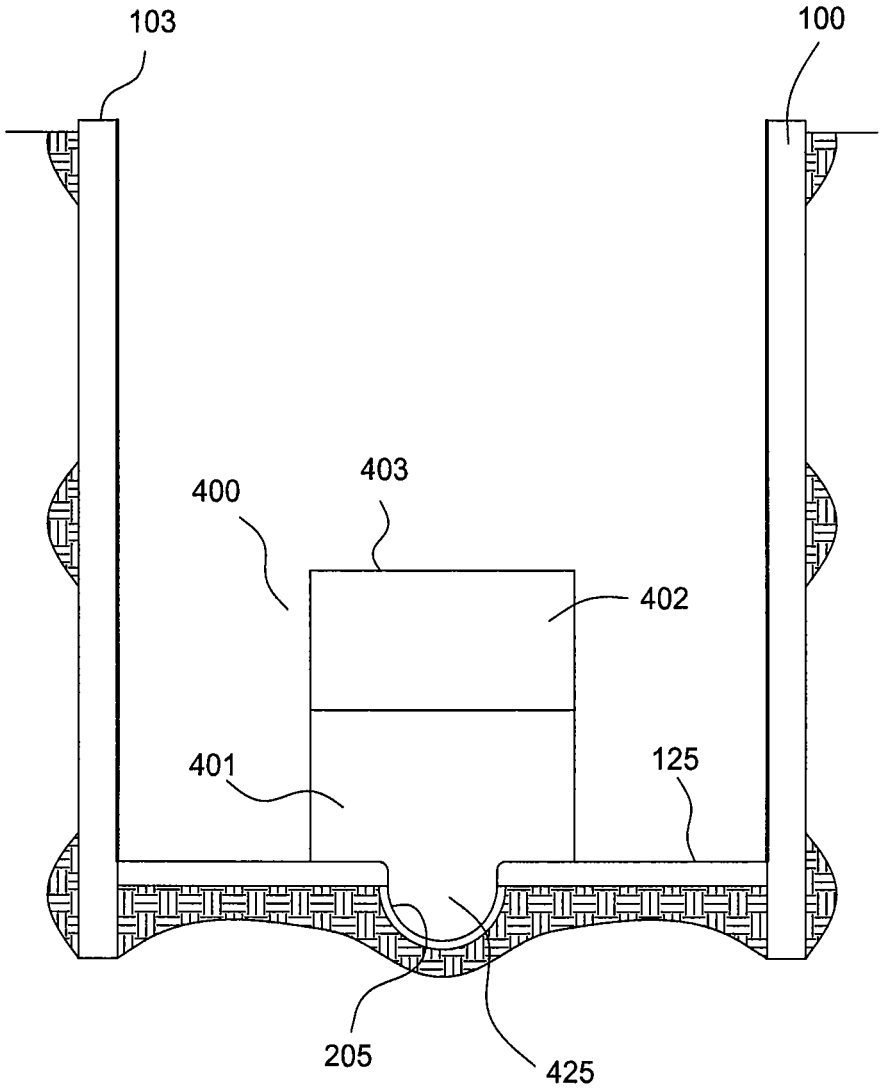
FIG. 3 is a side view of the chamber, in section, showing the dam and its position relative to the sewer pipe.

In the event a nearby, downstream lift station needs to be taken off-line for maintenance or in the event of a failure, the chamber 100 is exposed when the top is removed, making the chamber fully accessible from above. First, the pump assembly 300 and the dam 400 are deployed to the site. Thereafter, the pumps 350 are installed and the piping plumbed to the top of the chamber 100 and onwards to a downstream point where the fluid will be re-introduced into the sewer. The dam 400 is assembled using the required number of portions to ensure its height in relation to the fluid level expected in the chamber 100 during the diversion job. Prior to installing the dam, with the flow at some reduced level through the sewer line, the top half of the sewer pipe 200 is removed, leaving the trough-shaped lower portion 205. At this point, the floor 125 of the chamber 100 might be poured and extend over the remaining edges of the pipe 200 as shown in FIG. 3. The dam is then installed in the chamber, and all personnel are evacuated from the chamber. Thereafter, with fluid flow blocked in a downstream direction, the fluid level in the chamber 100 rises. At a predetermined level, one or more of the pumps 350 will begin operating to move the fluid through the diversion pipe. With the sewer section and/or station isolated, work can begin while the chamber and its equipment keep the fluid diverted. After the repairs or maintenance are complete, the dam 400 is removed along with the pump assembly 300, and associated equipment and the top is retuned to the chamber. At any time thereafter, the chamber can be used to again isolate a section of sewer or a facility.

The chamber 100 and dam 400 may include a built-in safety feature to prevent fluid from overflowing out of the top of the chamber 100. In some instances, the chamber 100 may receive an unexpected increase in fluid flow and/or the pump assembly 300 may fail, which can lead to an overflow of fluid in the chamber 100. To prevent fluid from flowing out of the top of the chamber 100 and into the surrounding environment, the height of the dam 400 may be constructed such that the fluid will flow over the dam 400 and into the open trough portion of the pipe 200 prior to reaching the top of the chamber 100. As illustrated in FIG. 3, the height of the wall of the dam 400 is less than the height of the chamber 100, e.g. the top of the dam 400 (illustrated by reference numeral 403) is at an elevational height less than the top of the chamber 100 (illustrated by reference numeral 103). Thus, as the fluid level in the chamber 100 exceeds the height of the dam 400, the fluid will flow into the dry side of the dam 400 and out through the pipe 200.

Using the apparatus and methods described, a pump station or section of sewer line can be completely bypassed and all parts of it accessible for repairs, maintenance or modifications. When bypassing is no longer needed, the dam will be removed, the pump station restarted and the bypass pumps removed. The dam and pump support frame can be returned to storage. The same dam and pump support frame can be used at other similar facilities. This same type of chamber can be constructed as part of a new pump station to provide a way to effectively deal with emergencies in the future. The installation of the diversion chamber can be done relatively quickly and does not require a shored excavation or an extensive groundwater pumping system.

The invention has been described as utilizing a number of steps. While the steps have been described as occurring in a certain order it will be understood that such a particular order is not necessary. For instance, the order in which the pump(s) and dam are installed is flexible so long as an upstream side of the chamber is isolated from a downstream section prior to evacuation and transfer of fluid from the upstream side to a remote location.

While the foregoing is directed to embodiments of the present invention, other and further embodiments of the invention may be devised without departing from the basic scope thereof, and the scope thereof is determined by the claims that follow.

The invention claimed is:

1. A method of isolating a section of sewer line, comprising:

providing a chamber, the chamber extending into the ground and intersecting a sewer pipe, the sewer pipe having an upstream end and an downstream end;

exposing an interior of the chamber to fluid flow from the sewer pipe by removing a portion of the sewer pipe;

placing a dam in the chamber to isolate an upstream portion of the chamber from a downstream portion of the chamber;

draining fluid from the downstream portion of the chamber;

placing at least one pump in the upstream portion of the chamber; and selectively utilizing the at least one pump to control the fluid level in the upstream portion due to the fluid flow, the pump transferring the fluid from the chamber to a predetermined, remote location.

2. The method of claim 1 whereby, prior to exposing the chamber to fluid flow, the flow in the sewer pipe is maintained at a low level.

3. The method of claim 1, wherein the fluid is transferred to a remote location via fluid conductors extending from the at least one pump.

4. The method of claim 1, further including removing the dam, pumps and re-permitting fluid communication between the upstream and downstream portions.

5. The method of claim 1, wherein fluid flows across the removable dam and into the downstream portion of the chamber prior to reaching a top of the chamber.

6. The method of claim 1, wherein the portion of the sewer pipe removed includes an upper portion, whereby a lower semicircular shaped bottom portion remains and extends through a bottom of the chamber.

7. The method of claim 6, wherein the dam has a semicircular-shaped tongue formed at a bottom thereof for mating with the semicircular shaped bottom portion of the pipe.

8. The method of claim 7, wherein an interior wall of the chamber is circular.

9. The method of claim 8, wherein the dam has a concave side and a convex side, and is installable in a manner whereby the concave side faces the downstream side of the sewer pipe.

10. The method of claim 9, wherein the sides of the dam are constructed and arranged to seal against the interior wall of the chamber, and wherein a height of the dam is less than a height of the chamber.

11. A method of isolating a section of sewer line, comprising:

providing a chamber, the chamber extending into the ground and intersecting a sewer pipe, the sewer pipe having an upstream end and an downstream end;

exposing an interior of the chamber to fluid flow from the sewer pipe;

placing a dam in the chamber to isolate an upstream portion of the chamber from a downstream portion of the chamber;

draining fluid from the downstream portion of the chamber;

placing a submersible pump in the upstream portion of the chamber;

and selectively utilizing the submersible pump to control the fluid level in the upstream portion due to the fluid flow, the pump transferring the fluid from the chamber to a predetermined, remote location.

12. The method of claim 11, wherein the submersible pump is suspended from a frame, the frame supported by an upper edge of the chamber wall.

13. A method of isolating a section of sewer line, comprising:

providing a chamber, the chamber extending into the ground and intersecting a sewer pipe, the sewer pipe having an upstream end and an downstream end;

exposing an interior of the chamber to fluid flow from the sewer pipe;

placing a dam in the chamber to isolate an upstream portion of the chamber from a downstream portion of the chamber, wherein the dam includes at least two vertical sections, the sections stackable to increase the overall height of the dam;

draining fluid from the downstream portion of the chamber;

placing at least one pump in the upstream portion of the chamber;

and selectively utilizing the at least one pump to control the fluid level in the upstream portion due to the fluid flow, the pump transferring the fluid from the chamber to a predetermined, remote location.

* * * * *